US011183120B2

(12) United States Patent
Wang et al.

(10) Patent No.: US 11,183,120 B2
(45) Date of Patent: Nov. 23, 2021

(54) PIXEL ARRAY SUBSTRATE HAVING COMMON ELECTRODES DISTRIBUTED IN PLURALITY OF PIXEL ROWS AND DRIVING METHOD THEREOF

(71) Applicant: BOE TECHNOLOGY GROUP CO., LTD., Beijing (CN)

(72) Inventors: Ling Wang, Beijing (CN); Pan Xu, Beijing (CN); Yi Cheng Lin, Beijing (CN); Xing Zhang, Beijing (CN); Ying Han, Beijing (CN); Guang Yan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/648,522

(22) PCT Filed: Mar. 15, 2019

(86) PCT No.: PCT/CN2019/078328
§ 371 (c)(1),
(2) Date: Mar. 18, 2020

(87) PCT Pub. No.: WO2020/186396
PCT Pub. Date: Sep. 24, 2020

(65) Prior Publication Data
US 2020/0294449 A1 Sep. 17, 2020

(51) Int. Cl.
*G09G 3/3258* (2016.01)
*G09G 3/3266* (2016.01)
*G09G 3/3291* (2016.01)

(52) U.S. Cl.
CPC ..... *G09G 3/3258* (2013.01); *G09G 3/3266* (2013.01); *G09G 3/3291* (2013.01); *G09G 2300/0426* (2013.01)

(58) Field of Classification Search
CPC ..... G09G 3/3258
(Continued)

(56) References Cited

U.S. PATENT DOCUMENTS 7,248,237 B2 7/2007 Kamada et al.
9,111,888 B2 8/2015 Do et al.
(Continued)

FOREIGN PATENT DOCUMENTS

CN 1578975 A 2/2005
CN 104681588 A 6/2015
(Continued)

OTHER PUBLICATIONS

First Chinese Office Action for Chinese Application Serial No. 201980000331.6, dated Sep. 24, 2021 and the English translation.

*Primary Examiner* — Long D Pham
(74) *Attorney, Agent, or Firm* — Collard & Roe, P.C.

(57) ABSTRACT

Disclosed are a pixel array substrate and a driving method thereof, a display panel, and a display device. The pixel array substrate includes a plurality of pixel units arranged in a plurality of pixel rows, and common electrodes distributed in the plurality of pixel rows. Each of the plurality of pixel units includes a light emitting element, first electrodes of light emitting elements of a plurality of pixel units in each of the plurality of pixel rows are electrically connected with each other to form a common electrode in the each of the plurality of pixel rows, and the common electrodes in the plurality of pixel rows are insulated from each other.

14 Claims, 7 Drawing Sheets

(58) Field of Classification Search
USPC ..... 345/214
See application file for complete search history.

(56) References Cited

U.S. PATENT DOCUMENTS

| | | | | |
|---|---|---|---|---|
| 9,524,669 | B2 | 12/2016 | Sato | |
| 10,643,531 | B2 | 5/2020 | Li et al. | |
| 2009/0284515 | A1* | 11/2009 | Tsuge | G09G 3/3233 345/211 |
| 2015/0090988 | A1 | 4/2015 | Oooka et al. | |
| 2016/0203765 | A1 | 7/2016 | Lee | |
| 2017/0132974 | A1* | 5/2017 | Matsueda | G09G 3/3275 |
| 2017/0270861 | A1* | 9/2017 | Izumi | G09G 3/3233 |
| 2018/0357963 | A1 | 12/2018 | Gai et al. | |
| 2019/0164492 | A1* | 5/2019 | Oh | G09G 3/3258 |

FOREIGN PATENT DOCUMENTS

| | | | |
|---|---|---|---|
| CN | 107331685 | A | 11/2017 |
| CN | 107591126 | A | 1/2018 |
| CN | 107885400 | A | 4/2018 |
| CN | 108761856 | A | 11/2018 |
| CN | 108877669 | A | 11/2018 |
| JP | 2015025945 | A | 2/2015 |

* cited by examiner

PIXEL ARRAY SUBSTRATE HAVING COMMON ELECTRODES DISTRIBUTED IN PLURALITY OF PIXEL ROWS AND DRIVING METHOD THEREOF

CROSS REFERENCE TO RELATED APPLICATIONS

This application is the National Stage of PCT/CN2019/078328, filed on Mar. 15, 2019, the disclosure of which is incorporated by reference.

TECHNICAL FIELD

Embodiments of the present disclosure relate to a pixel array substrate and a driving method thereof, a display panel, and a display device.

BACKGROUND

An organic light-emitting diode (OLED) display panel has the advantages of the thin thickness, light weight, wide viewing angle, active luminescence, continuously adjustable luminous color, low cost, fast response speed, low energy consumption, low driving voltage, wide operating temperature range, simple production process, high luminous efficiency, flexible display, etc., and has been widely used in the display fields of mobile phones, tablet computers, digital cameras, etc.

SUMMARY

At least one embodiment of the present disclosure provides a pixel array substrate, and the pixel array substrate includes: a plurality of pixel units arranged in a plurality of pixel rows, and common electrodes distributed in the plurality of pixel rows; and each of the plurality of pixel units includes a light emitting element, first electrodes of light emitting elements of a plurality of pixel units in each of the plurality of pixel rows are electrically connected with each other to form a common electrode in the each of the plurality of pixel rows, and the common electrodes in the plurality of pixel rows are insulated from each other.

For example, in the pixel array substrate provided by an embodiment of the present disclosure, the common electrode in the each of the plurality of pixel rows is configured to receive a first power signal to set the light emitting elements of the plurality of pixel units in the each of the plurality of pixel rows in a reverse bias state during a non-light emitting phase of the plurality of pixel units in the each of the plurality of pixel rows, and to receive a second power signal to set the light emitting elements of the plurality of pixel units in the each of the plurality of pixel rows in a forward bias state during a light emitting phase of the plurality of pixel units in the each of the plurality of pixel rows.

For example, the pixel array substrate provided by an embodiment of the present disclosure further includes a plurality of power signal lines in one-to-one correspondence with the plurality of pixel rows; and the common electrode in the each of the plurality of pixel rows is connected with a power signal line corresponding to the each of the plurality of pixel rows, and the first power signal and the second power signal are transmitted to the common electrode in the each of the plurality of pixel rows via the power signal line corresponding to the each of the plurality of pixel rows.

For example, the pixel array substrate provided by an embodiment of the present disclosure further includes a pixel defining layer for defining the plurality of pixel units; and the pixel defining layer includes a plurality of via holes, and the common electrode in the each of the plurality of pixel rows is connected with the power signal line corresponding to the each of the plurality of pixel rows through at least one of the plurality of via holes.

For example, the pixel array substrate provided by an embodiment of the present disclosure further includes a plurality of auxiliary cathodes in one-to-one correspondence with the plurality of via holes; and the common electrode in the each of the plurality of pixel rows is connected with at least one of the plurality of auxiliary cathodes through at least one of the plurality of via holes, and the power signal line corresponding to the each of the plurality of pixel rows is connected with the at least one of the plurality of auxiliary cathodes.

For example, in the pixel array substrate provided by an embodiment of the present disclosure, each of the plurality of pixel units further includes a driving circuit, a storage capacitor and a driving control circuit; a first terminal of the driving circuit is connected with a first node, a second terminal of the driving circuit is connected with a second node, and a control terminal of the driving circuit is connected with a third node and is configured to control a driving current flowing through the first node and the second node for driving the light emitting element; a second electrode of the light emitting element is connected with the second node; a first terminal of the storage capacitor is coupled to the control terminal of the driving circuit, and a second terminal of the storage capacitor is coupled to the second terminal of the driving circuit; and the driving control circuit is configured to respectively apply a reference voltage signal and a data voltage signal to the control terminal of the driving circuit in response to a scan signal, and to provide a first voltage to the first node in response to a light emitting control signal, and to reset the second node in response to a reset signal.

For example, in the pixel array substrate provided by an embodiment of the present disclosure, the driving circuit includes a driving transistor, a first electrode of the driving transistor serves as the first terminal of the driving circuit, a second electrode of the driving transistor serves as the second terminal of the driving circuit, and a gate electrode of the driving transistor serves as the control terminal of the driving circuit.

For example, in the pixel array substrate provided by an embodiment of the present disclosure, the driving control circuit includes: a switching circuit, configured to respectively apply the reference voltage signal and the data voltage signal to the control terminal of the driving circuit in response to the scan signal.

For example, in the pixel array substrate provided by an embodiment of the present disclosure, the switching circuit includes a first transistor, a gate electrode of the first transistor is connected with a scan signal terminal to receive the scan signal, a first electrode of the first transistor is connected with a data signal terminal to receive the reference voltage signal and the data voltage signal, and a second electrode of the first transistor is connected with the third node.

For example, in the pixel array substrate provided by an embodiment of the present disclosure, the driving control circuit further includes: a light emitting control circuit, configured to provide the first voltage to the first node in response to the light emitting control signal.

For example, in the pixel array substrate provided by an embodiment of the present disclosure, the light emitting control circuit includes a second transistor, a gate electrode of the second transistor is connected with a light emitting control signal terminal to receive the light emitting control signal, a first electrode of the second transistor is connected with a first power terminal to receive the first voltage, and a second electrode of the second transistor is connected with the first node.

For example, in the pixel array substrate provided by an embodiment of the present disclosure, the driving control circuit further includes: a reset circuit, configured to reset the second node in response to the reset signal.

For example, in the pixel array substrate provided by an embodiment of the present disclosure, the reset circuit includes a third transistor, a gate electrode of the third transistor is connected with a reset signal terminal to receive the reset signal, a first electrode of the third transistor is connected with a reset voltage terminal to receive a reset voltage, and a second electrode of the third transistor is connected with the second node.

For example, in the pixel array substrate provided by an embodiment of the present disclosure, each of the plurality of pixel units further includes a first capacitor, a first terminal of the first capacitor is coupled to the first electrode of the light emitting element, and a second terminal of the first capacitor is coupled to the second electrode of the light emitting element.

At least one embodiment of the present disclosure further provides a display panel, and the display panel includes the pixel array substrate provided by any one of the embodiments of the present disclosure.

At least one embodiment of the present disclosure further provides a display device, and the display device includes the display panel provided by any one of the embodiments of the present disclosure.

At least one embodiment of the present disclosure further provides a driving method of a pixel array substrate, and the driving method includes: providing, during a non-light emitting phase of the plurality of pixel units in each of the plurality of pixel rows, a first power signal to the common electrode in the each of the plurality of pixel rows, so as to set the light emitting elements of the plurality of pixel units in the each of the plurality of pixel rows in a reverse bias state; and providing, during a light emitting phase of the plurality of pixel units in the each of the plurality of pixel rows, a second power signal to the common electrode in the each of the plurality of pixel rows, so as to set the light emitting elements of the plurality of pixel units in the each of the plurality of pixel rows in a forward bias state.

For example, in the driving method provided by an embodiment of the present disclosure, each of the plurality of pixel units further includes a driving circuit, a storage capacitor, a switching circuit, a light emitting control circuit and a reset circuit; a first terminal of the driving circuit is connected with a first node, a second terminal of the driving circuit is connected with a second node, and a control terminal of the driving circuit is connected with a third node and is configured to control a driving current flowing through the first node and the second node for driving the light emitting element; a second electrode of the light emitting element is connected with the second node; a first terminal of the storage capacitor is coupled to the control terminal of the driving circuit, and a second terminal of the storage capacitor is coupled to the second terminal of the driving circuit; the switching circuit is configured to respectively apply a reference voltage signal and a data voltage signal to the control terminal of the driving circuit in response to a scan signal; the light emitting control circuit is configured to provide a first voltage to the first node in response to a light emitting control signal; the reset circuit is configured to reset the second node in response to a reset signal; the non-light emitting phase includes a reset phase, a compensation phase and a data writing phase; and the driving method further includes: during the reset phase, inputting the reset signal, the scan signal and the reference voltage signal, so that the reset circuit and the switching circuit are turned on, the reset circuit resets the light emitting element, the switching circuit writes the reference voltage signal into the control terminal of the driving circuit, and the reference voltage signal is stored in the storage capacitor; during the compensation phase, inputting the scan signal, the light emitting control signal and the reference voltage signal, so that the switching circuit, the driving circuit and the light emitting control circuit are turned on, the switching circuit continuously writes the reference voltage signal into the control terminal of the driving circuit to maintain a voltage of the control terminal of the driving circuit, and the light emitting control circuit compensates for the driving circuit; during the data writing phase, inputting the scan signal and the data voltage signal, so that the switching circuit is turned on, the switching circuit writes the data voltage signal into the control terminal of the driving circuit, and the data voltage signal is stored in the storage capacitor; and during the light emitting phase, inputting the light emitting control signal, so that the light emitting control circuit and the driving circuit are turned on, and the driving circuit applies the driving current to the light emitting element so as to drive the light emitting element to emit light.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

Figure 1:
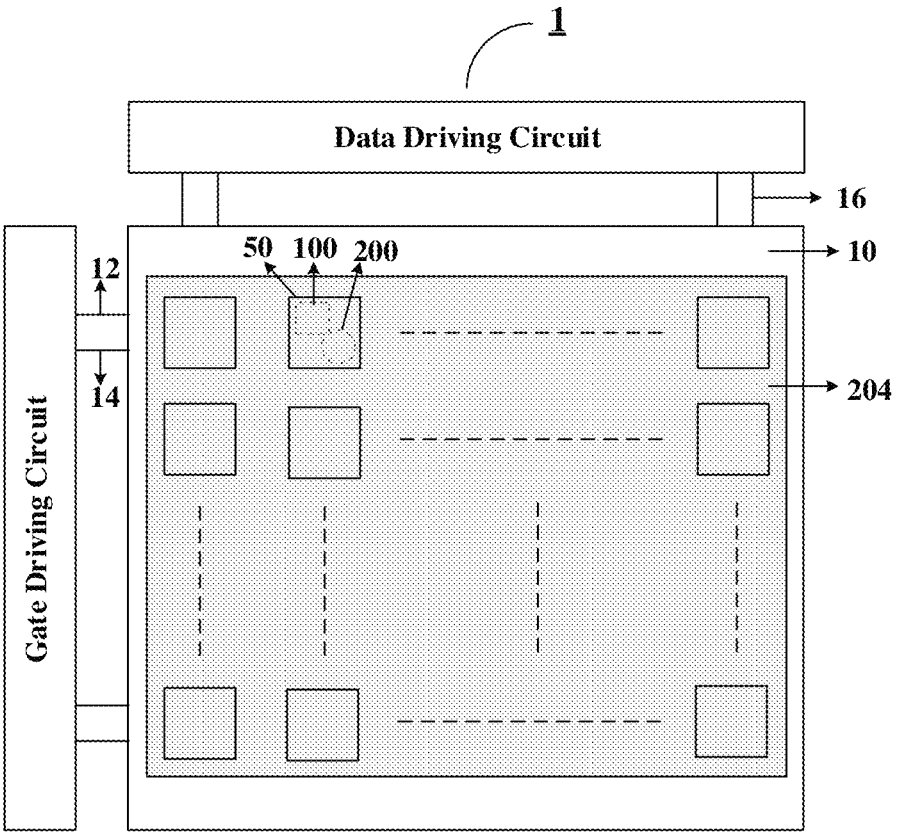
FIG. 1 is a schematic structural diagram of a display panel.

In order to make objects, technical details and advantages of the embodiments of the present disclosure apparent, the technical solutions of the embodiment will be described in a clearly and fully understandable way in connection with the drawings related to the embodiments of the present disclosure. It is obvious that the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms "a," "an" or "the," etc., are not intended to indicate a limitation of quantity, but rather indicate the presence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "Upper", "lower", "left", "right", etc. are only used to indicate the relative positional relationship, and when the absolute position of the object to be described is changed, the relative positional relationship may also change accordingly.

The present disclosure will be described below through several specific embodiments. In order to keep the description of the embodiments of the present disclosure clear and concise, detailed descriptions of known functions and known components (members) may be omitted. When any component of the embodiments of the present disclosure appears in more than one drawing, the component is denoted by the same or similar reference numeral in each drawing.

FIG. 1 is a schematic structural diagram of a display panel. As shown in FIG. 1, the display panel 1 includes a pixel array substrate 10, and the pixel array substrate 10 includes a plurality of pixel units 50 arranged in an array. Each pixel unit 50 includes a pixel circuit 100 and a light emitting element 200. The light emitting element 200 can be an organic light-emitting diode (OLED) or a quantum dot light-emitting diode (QLED).

As shown in FIG. 1, the display panel 1 further includes a gate driving circuit, and the gate driving circuit can provide a scan signal to the pixel circuit 100 via a gate line 12. For example, the gate driving circuit can be implemented by an integrated circuit driving chip which is bonded, and can also be directly integrated on the pixel array substrate 10 to form a GOA (Gate driver On Array). For example, as shown in FIG. 1, as needed by the pixel circuit 100, the gate driving circuit (or other driving circuits additionally provided) can further provide, via a control line 14, other required control signals, such as a light emitting control signal, a reset signal, etc., to the pixel circuit 100. And the control line 14 can include, as needed, a variety of control lines, such as a light emitting control line, a reset control line, etc.

As shown in FIG. 1, the display panel 1 further includes a data driving circuit, and the data driving circuit can provide a data signal to the pixel circuit 100 via a data line 16. For example, the data driving circuit can be implemented by an integrated circuit driving chip which is bonded.

In addition, as shown in FIG. 1, cathodes of light emitting elements 200 of the plurality of pixel units 50 arranged in an array often form a large whole common cathode 204, so as to save process and manufacturing cost.

When the display panel 1 displays a frame of image, in each pixel unit 50, the pixel circuit 100 generates a driving current flowing through the light emitting element 200 to drive the light emitting element 200 to emit light according to a data signal provided by the data driving circuit under the control of signals (e.g., a scan signal, a reset signal, a light emitting control signal, etc.) provided by the gate driving circuit, so as to display.

Figure 2:
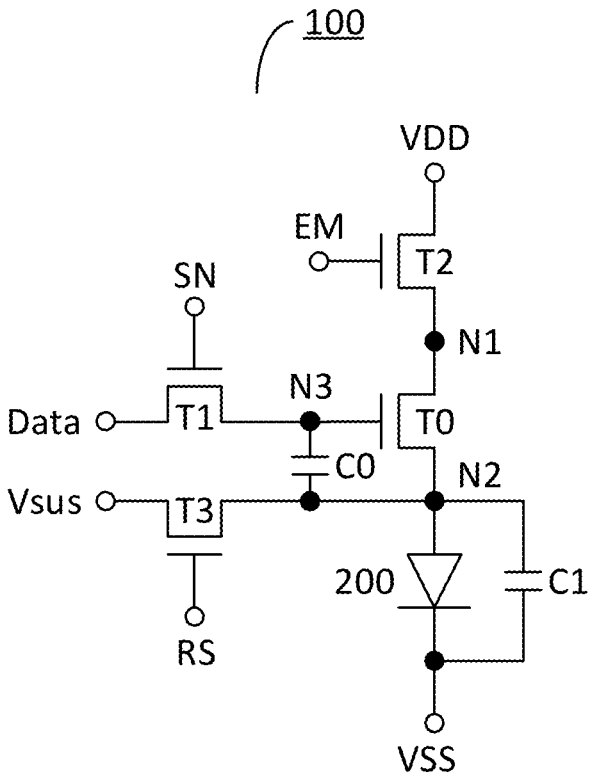
FIG. 2 is a circuit diagram of a pixel circuit in the display panel shown in FIG. 1.

FIG. 2 is a circuit diagram of a pixel circuit in the display panel shown in FIG. 1. As shown in FIG. 2, the pixel circuit 100 includes a driving transistor T0, a first transistor T1, a second transistor T2, a third transistor T3, a storage capacitor C0, and a first capacitor C1. The drain electrode of the driving transistor T0 is connected with a first node N1, the source electrode of the driving transistor T0 is connected with a second node N2, and the gate electrode of the driving transistor T0 is connected with a third node N3; the drain electrode of the first transistor T1 is connected with a data signal terminal via a data line to receive a data signal DATA, the source electrode of the first transistor T1 is connected with the third node N3, and the gate electrode of the first transistor T1 is connected with a scan signal terminal via a gate line to receive a scan signal SN; the drain electrode of the second transistor T2 is connected with a first power terminal to receive a first voltage VDD (a high-level voltage), the source electrode of the second transistor T2 is connected with the first node N1, and the gate electrode of the second transistor T2 is connected with a light emitting control signal terminal via a light emitting control line to receive a light emitting control signal EM; the drain electrode of the third transistor T3 is connected with a reset voltage terminal to receive a reset voltage Vsus, the source electrode of the third transistor T3 is connected with the second node N2, and the gate electrode of the third transistor T3 is connected with a reset signal terminal via a reset control line to receive a reset signal RS; a first terminal of the storage capacitor C0 is coupled to the gate electrode of the driving transistor T0, and a second terminal of the storage capacitor C0 is coupled to the source electrode of the driving transistor; the anode of the light emitting element 200 is connected with the second node N2, and the cathode of the light emitting element 200 is connected with a second power terminal to receive a second voltage VSS (a low-level voltage, e.g., a ground voltage); and a first terminal of the first capacitor C1 is coupled to the cathode of the light emitting element 200, and a second terminal of the first capacitor C1 is coupled to the anode of the light emitting element 200. All the transistors in the pixel circuit 100 shown in FIG. 2 are exemplified by N-type transistors.

Figure 3:
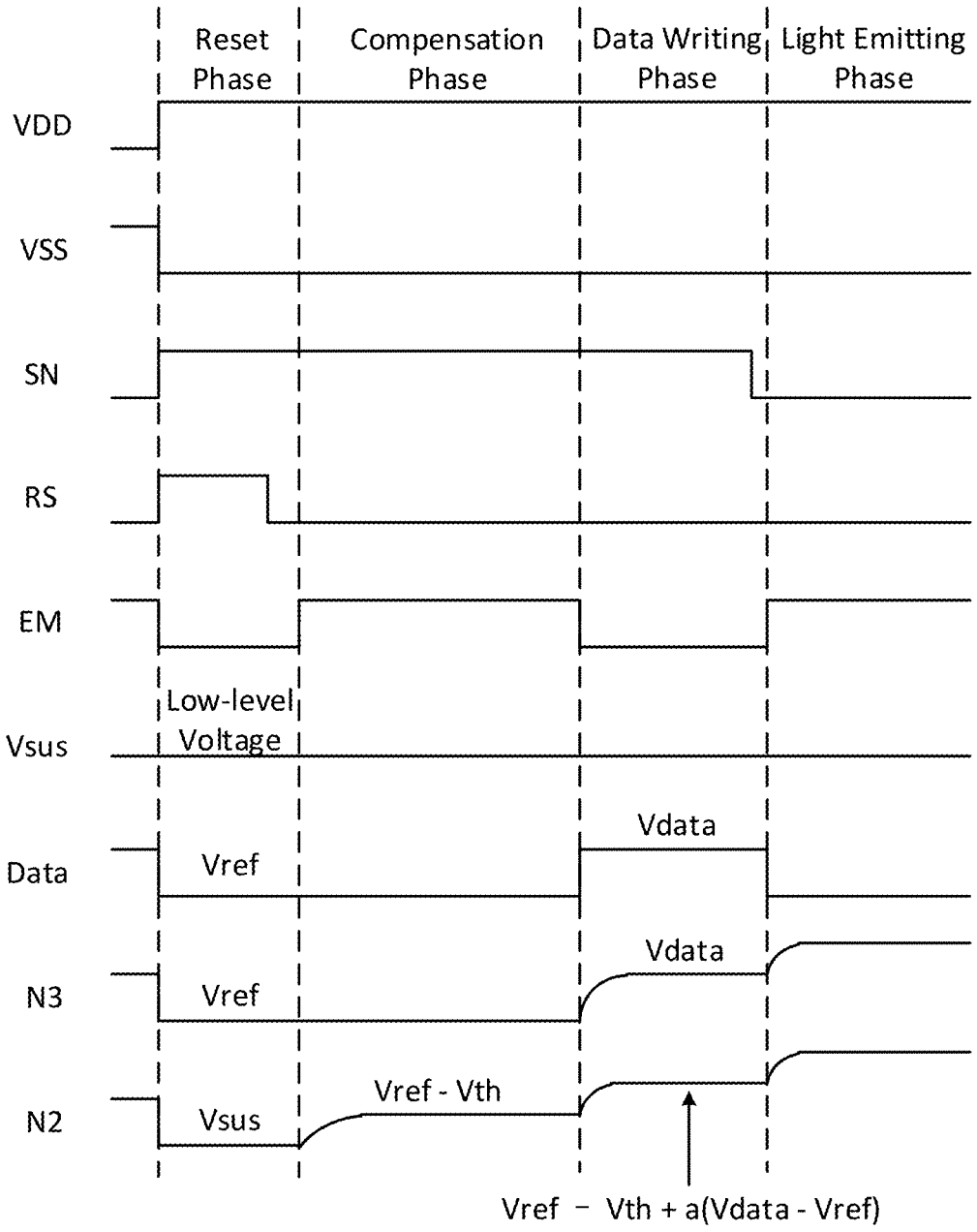
FIG. 3 is a signal timing chart when the pixel circuit shown in FIG. 2 is in operation.

FIG. 3 is a signal timing chart when the pixel circuit shown in FIG. 2 is in operation. The operation principle of the pixel circuit 100 shown in FIG. 2 will be described with reference to the signal timing chart shown in FIG. 3. When the pixel circuit 100 is in operation, the first voltage VDD is kept as a high-level voltage, the second voltage VSS is kept as a low-level voltage, and the reset voltage Vsus is a low-level voltage which cannot drive the light emitting element 200 to emit light. These details will not be repeated in the following description of the operation principle of the pixel circuit 100. The operation principle of the pixel circuit 100 includes the following.

During a reset phase, the scan signal SN is at a high level, so as to turn on the first transistor T1, and the data signal DATA (i.e., a reference voltage signal Vref) at this time is transmitted to the third node N3 via the first transistor T1, so as to reset the first terminal of the storage capacitor C0 to Vref; the light emitting control signal EM is at a low level, so as to turn off the second transistor T2; and when the reset signal RS is at a high level, the third transistor T3 is turned on, and the reset voltage Vsus is transmitted to the second node N2 via the third transistor T3, so as to reset the second terminal of the storage capacitor C0 and the second terminal of the first capacitor C1 to Vsus. Therefore, in this phase, the data signal stored in the storage capacitor C0 and the gate voltage of the driving transistor T0 can be initialized. In addition, at the end of the reset phase, the voltage difference across the storage capacitor C0 is Vref−Vsus, which is greater than the threshold voltage Vth of the driving transistor T0 (i.e., Vref−Vsus>Vth). Thus, the driving transistor T0 can be in an on state.

During a compensation phase, the scan signal SN is at a high level, so as to turn on the first transistor T1, and the reference voltage signal Vref is transmitted to the third node N3 via the first transistor T1 to maintain the first terminal of the storage capacitor C0 at Vref; the reset signal RS is at a low level, so as to turn off the third transistor T3; and the light emitting control signal EM is at a high level, so as to turn on the second transistor T2. Because the driving transistor T0 is in an on state at the beginning of the compensation phase (i.e., at the end of the reset phase), the first voltage VDD can charge the second node N2 (i.e., the second terminal of the storage capacitor C0) via the second transistor T2 and the driving transistor T0. According to the characteristics of the driving transistor T0 itself (i.e., there exists the threshold voltage Vth), when the second terminal of the storage capacitor C0 and the second terminal of the first capacitor C1 are charged to Vref−Vth, the driving transistor T0 is turned off and the charging process ends. At the end of the compensation phase, the voltage difference across the storage capacitor C0 is Vth, that is, the compensation for the threshold voltage of the driving transistor T0 itself is realized.

During a data writing phase, the reset signal RS is at a low level, so as to turn off the third transistor T3; the light emitting control signal EM is at a low level, so as to turn off the second transistor T2; and when the scan signal SN is at a high level, the first transistor T1 is turned on, and the data signal DATA (i.e., a data voltage signal Vdata) at this time is transmitted to the third node N3 via the first transistor T1, and is stored in the storage capacitor C0 for turning on the driving transistor T0 in a subsequent light emitting phase to supply the driving current for the light emitting element 200.

During a light emitting phase, the scan signal SN is at a low level, so as to turn off the first transistor T1; the reset signal RS is at a low level, so as to turn off the third transistor T3; and the light emitting control signal EM is at a high level, so as to turn on the second transistor T2. At this time, the driving current generated in response to the voltage signal (i.e., the voltage signal stored in the storage capacitor C0 at the end of the data writing phase), which is applied to the gate electrode of the driving transistor T0 and is related to Vdata, is supplied to the light emitting element 200 via the driving transistor T0, so as to drive the light emitting element 200 to emit light.

In research, the inventors of the present application have found that the light emitting element 200 (e.g. an organic light-emitting diode) also has a capacitance Coled itself. In the above-mentioned data writing phase, because both the second transistor T2 and the third transistor T3 are turned off, there is no direct current path through the second node N2, and the second node N2 is in a floating state; and while the first transistor T1 is turned on, the potential of the third node N3 jumps from Vref to Vdata. Due to the bootstrap effect of the storage capacitor C0, the potential of the second node N2 will also change accordingly. Because the storage capacitor C0, the first capacitor C1 and the capacitance Coled of the light emitting element 200 are coupled to each other, the potential change of the second node N2 is:

$$a\ (V\text{data}-V\text{ref}),\ \text{where}\ a=C0/(C0+C1+Coled).$$

Therefore, at this time, the voltage difference between the gate electrode and the source electrode of the driving transistor T0 is:

$$V_{GS}=(V\text{data}-V\text{ref})\cdot(1-a)+\text{Vth}$$

Furthermore, during the light emitting phase, the driving current supplied by the driving transistor T0 is:

$$I=\frac{\beta}{2}(V_{GS}-Vth)^2=\frac{\beta}{2}[(Vdata-Vref)\cdot(1-a)]^2,$$

where I represents the driving current and β represents a constant value.

Figure 4:
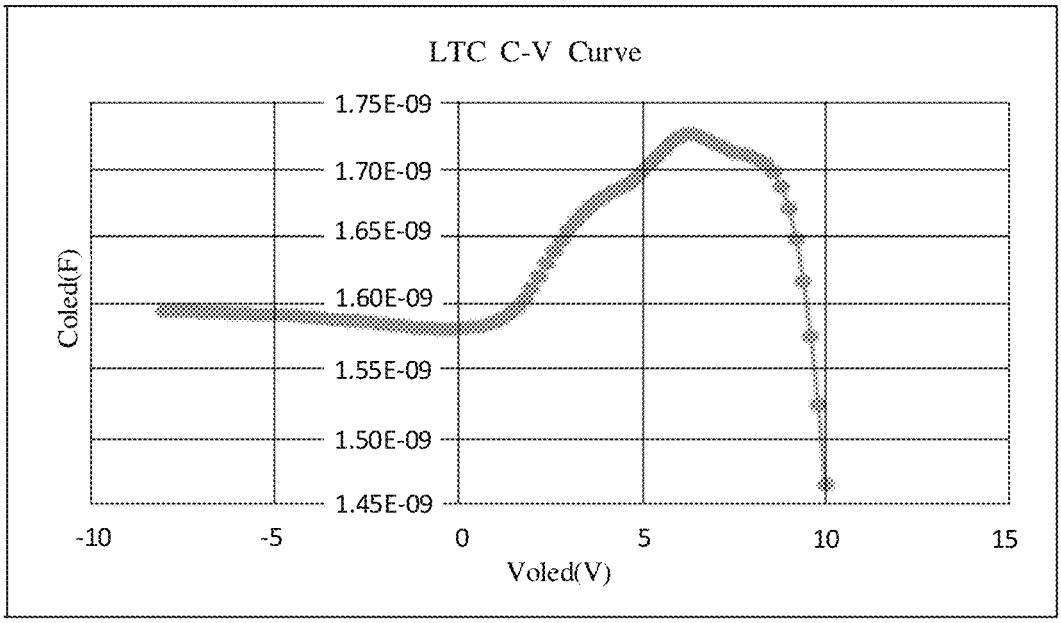
FIG. 4 is a graph of a capacitance-voltage variation curve of an organic light-emitting diode in the display panel shown in FIG. 1.

In addition, the inventors of the present application have also found that, as shown in FIG. 4, the capacitance Coled of the light emitting element 200 (e.g., an organic light-emitting diode) varies with the variation of the voltage Voled across the anode and cathode of the light emitting element 200. In a forward bias state of the light emitting element 200, the change of the capacitance Coled is relatively severe; and while in a reverse bias state of the light emitting element 200, the change of the capacitance Coled is relatively small. Namely, in the reverse bias state of the light emitting element 200, the capacitance Coled is relatively stable. According to the above analysis of the operation principle of the pixel circuit 100, in the above data writing phase, the light emitting element 200 is in a forward bias state; and when the data voltage signals Vdata being written are different, the parameters a are also different, thus leading to that a precise control of the driving current is difficult and a precise control of the brightness of the light emitting element is also difficult.

At least one embodiment of the present disclosure provides a pixel array substrate, which includes a plurality of pixel units arranged in a plurality of pixel rows, and common electrodes distributed in the plurality of pixel rows. Each pixel unit includes a light emitting element; and first electrodes of light emitting elements of a plurality of pixel units in each pixel row are electrically connected with each other to form a common electrode in the each pixel row, and the common electrodes in the plurality of pixel rows are insulated from each other.

Some embodiments of the present disclosure further provide a driving method, a display panel and a display device corresponding to the above pixel array substrate.

As for the pixel array substrate provided by the above embodiment of the present disclosure, when driving the pixel units in the pixel array substrate to emit light, by adjusting the voltage of the common electrode in each pixel row, the light emitting elements of the pixel units in each pixel row are in a reverse bias state during a non-light emitting phase of the pixel units in each pixel row, and the light emitting elements of the pixel units in each pixel row are in a forward bias state during a light emitting phase of the pixel units in each pixel row, so that the brightness of the light emitting elements can be accurately controlled and the display quality is improved.

Some embodiments of the present disclosure and examples thereof will be described in detail below with reference to the accompanying drawings.

Figure 5A:
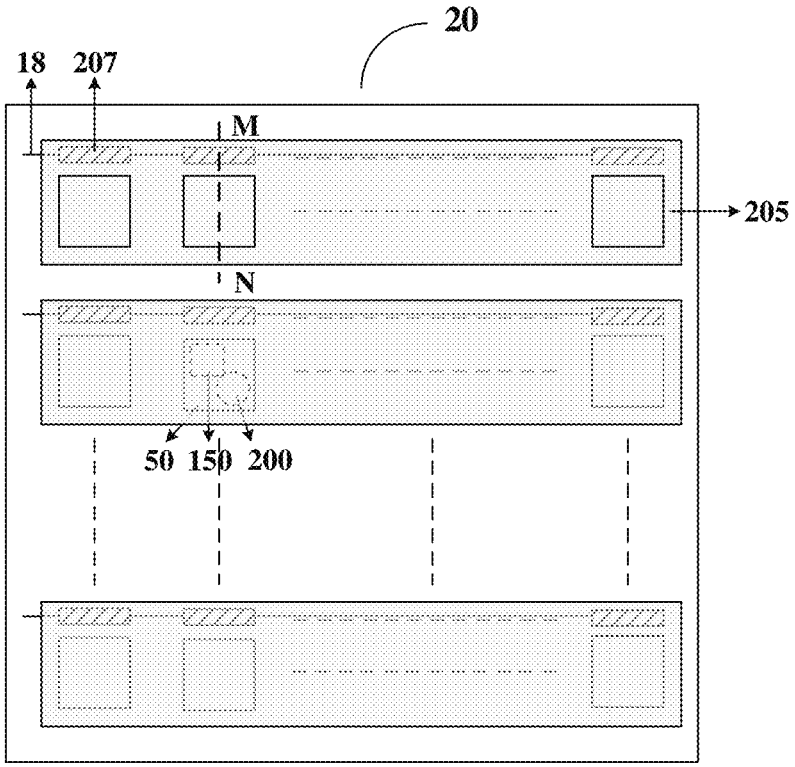
FIG. 5A is a schematic structural diagram of a pixel array substrate provided by an embodiment of the present disclosure.

FIG. 5A is a schematic structural diagram of a pixel array substrate provided by an embodiment of the present disclosure. As shown in FIG. 5A, the pixel array substrate 20 includes a plurality of pixel units 50 arranged in a plurality of pixel rows, and common electrodes 205 distributed in the plurality of pixel rows. Each pixel unit 50 includes a light emitting element 200; and first electrodes of light emitting elements 200 of a plurality of pixel units 50 in each pixel row are electrically connected with each other to form a common electrode 205 in that pixel row, and the common electrodes 205 in the plurality of pixel rows are insulated from each other. For example, the light emitting element 200 is an organic light-emitting diode or a quantum dot light-emitting diode, and the first electrode thereof is a cathode.

For example, the common electrodes 205 shown in FIG. 5A can be obtained by processing the whole common cathode 204 shown in FIG. 1 with a photolithography process; and alternatively, the common electrodes 205 can be directly formed when forming the cathodes of the light emitting elements 200 by using a mask process. The flow of the photolithography process and the flow of the mask process mentioned above can be with reference to the existing semiconductor process technology, without being limited in the present disclosure.

For example, in the pixel array substrate 20, the common electrode 205 in each pixel row is configured to receive a first power signal to set the light emitting elements 200 of the plurality of pixel units 50 in the each pixel row in a reverse bias state during a non-light emitting phase of the plurality of pixel units 50 in the each pixel row, and to receive a second power signal to set the light emitting elements 200 of the plurality of pixel units 50 in the each pixel row in a forward bias state during a light emitting phase of the plurality of pixel units 50 in the each pixel row. For example, the first power signal is at a high level which is capable of making the light emitting elements 200 in a reverse bias state, and the second power signal is at a low level (e.g., a ground level) which is capable of making the light emitting elements 200 in a forward bias state. For example, in some examples, the first power signal and the second power signal can be provided by a driving circuit similar to the gate driving circuit. For example, the driving circuit can also be formed on the pixel array substrate 20 in the form of GOA; alternatively, the gate driving circuit itself can provide the first power signal and the second power signal according to the requirements of the present disclosure; and alternatively, the first power signal and the second power signal can be provided by an integrated circuit driving chip, and for example, the integrated circuit driving chip can be bonded to the pixel array substrate 20 in the form of chip on film (C0F). It should be noted that the manner in which the first power signal and the second power signal are provided is not limited in the present disclosure.

For example, as shown in FIG. 5A, the pixel array substrate 20 further includes a plurality of power signal lines 18 in one-to-one correspondence with the plurality of pixel rows. The common electrode 205 in each pixel row is connected with a power signal line 18 corresponding to the each pixel row, and the first power signal and the second power signal described above are transmitted to the common electrode 205 in the each pixel row via the power signal line 18 corresponding to the each pixel row, so as to realize the above-mentioned function of changing the bias state of the light emitting elements 200.

Figure 5B:
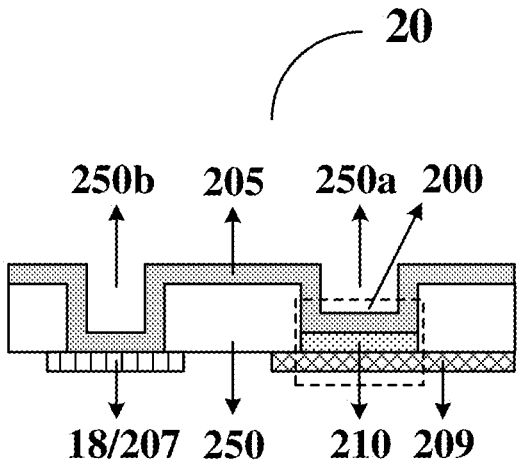
FIG. 5B is a schematic cross-sectional view of the pixel array substrate shown in FIG. 5A taken along a line M-N.

FIG. 5B is a schematic cross-sectional view of the pixel array substrate shown in FIG. 5A taken along a line M-N. For example, as shown in FIG. 5B, the pixel array substrate 20 further includes a pixel defining layer 250, and the pixel defining layer 250 is configured for defining (spacing) the plurality of pixel units 50. For example, in some examples, as shown in FIG. 5B, the pixel defining layer 250 defines a light emitting region (as shown by a dashed block in FIG. 5B) of the light emitting element 200 via an opening 250*a*, thereby defining the above-mentioned pixel unit 50. For example, in some examples, by taking that the light emitting element 200 includes an organic light-emitting diode as an example, as shown in FIG. 5B, in the pixel array substrate 20, the light emitting element 200 includes a cathode 205 (i.e., the first electrode of the light emitting element 200, i.e., the common electrode 205), an anode 209 (i.e., a second electrode of the light emitting element 200), and an organic thin film layer 210 disposed between the cathode 205 and the anode 209.

For example, in some examples, the organic thin film layer 210 can include a multi-layer structure composed of a hole injecting layer, a hole transporting layer, a light emitting layer (e.g. formed of an organic electroluminescent material), an electron transporting layer and an electron injecting layer, and can further include a hole blocking layer and an electron blocking layer. The hole blocking layer can be disposed, for example, between the electron transporting layer and the light emitting layer, and the electron blocking layer can be disposed, for example, between the hole transporting layer and the light emitting layer. The arrangement and material of each layer in the organic layer 210 can be with reference to common designs, without being limited in the embodiments of the present disclosure.

It should be noted that the materials, structures and formation methods of the cathode 205, the anode 209 and the organic thin film layer 210 of the light emitting element 200 are not limited in the embodiments of the present disclosure.

For example, as shown in FIGS. 5A and 5B, the pixel defining layer 50 includes a plurality of via holes 250*b*, and the common electrode 205 in each pixel row is connected with the power signal line 18 corresponding to the each pixel row through at least one of the via holes 250*b*. For example, in some examples, the common electrode 205 in each pixel row can be connected with the power signal line 18 corresponding to the each pixel row through a plurality of via holes 250*b*, thereby improving the conductivity of the common electrode 205.

For example, in some examples, especially in the case where the pixel array substrate 20 is used for a top-emission type organic light-emitting diode display panel, in order to take light transmittance into consideration, the transparent cathode of the light emitting element 200 has a thin thickness, resulting in poor conductivity of the common electrode 205. In order to improve the conductivity of the common electrode 205, as shown in FIG. 5A, a plurality of auxiliary cathodes 207 electrically connected with the common electrodes 205 can be provided. In this case, the power signal line 18 can be electrically connected with the auxiliary cathode 207, so as to realize an electrical connection with the common electrode 205 indirectly. For example, the auxiliary cathode 207 can be disposed in a non-light emitting region between the pixel units 50. For example, in some examples, as shown in FIGS. 5A and 5B, the plurality of auxiliary cathodes 207 are in one-to-one correspondence with the plurality of via holes 250*b* in the pixel defining layer 250, the common electrode 205 in each pixel row is connected with at least one of the auxiliary cathodes 207 through at least one of the via holes 250*b*, and the power signal line 18 corresponding to the each pixel row is connected with the at least one of the auxiliary cathodes 207, thereby realizing the electrical connection of the power signal line 18 and the common electrode 205 indirectly. For example, as shown in FIG. 5B, in this case, a projection of the power signal line 18 overlaps with a projection of the auxiliary cathode 207. It should be noted that the arrangement of the auxiliary cathodes 207 shown in FIG. 5B is illustrative. For example, in some examples, the auxiliary cathode 207 can be in direct contact with the common cathode 205 to realize an electrical connection; and for example, in other examples, other film layers can be disposed between the auxiliary cathode 207 and the common cathode 205. For example, the other film layer can be disposed on a same layer as the anode 209 and formed by a same patterning process as the anode 209, that is, the auxiliary cathode 207 and the common cathode 205 can be electrically connected indirectly.

It should be noted that the arrangement manner of the auxiliary cathodes of the pixel array substrate provided by the embodiments of the present disclosure is not limited. The power signal line 18 can be electrically connected with the auxiliary cathode so as to be electrically connected with the common electrode indirectly, or can be directly electrically connected with the common electrode without being electrically connected with the auxiliary cathode, which is not limited in the present disclosure. In addition, whether the pixel array substrate is provided with the auxiliary cathode is not limited in the embodiments of the present disclosure.

It should be noted that FIG. 5B is illustrative, in which other structures of the pixel array substrate 20, such as the structures of the base substrate and the pixel circuit, are omitted. The present disclosure is not limited thereto.

Figure 6A:
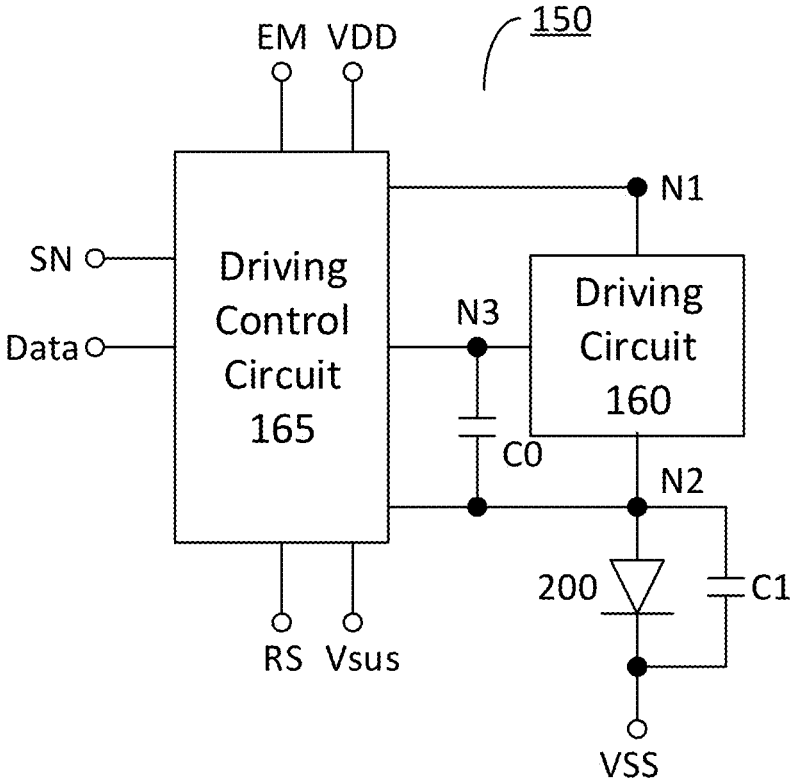
FIG. 6A is a schematic block diagram of a pixel circuit in the pixel array substrate shown in FIG. 5A.

For example, as shown in FIG. 5A, in the pixel array substrate 20, each pixel unit 50 further includes a pixel circuit 150. FIG. 6A is a schematic block diagram of a pixel circuit in the pixel array substrate shown in FIG. 5A. For example, as shown in FIG. 6A, the pixel circuit 150 includes a driving circuit 160, a storage capacitor C0, and a driving control circuit 165. A first terminal of the driving circuit 160 is connected with a first node N1, a second terminal of the driving circuit 160 is connected with a second node N2, and a control terminal of the driving circuit 160 is connected with a third node N3 and is configured to control a driving current which flows through the first node N1 and the second node N2 and is used for driving the light emitting element 200. A second electrode of the light emitting element 200 is connected with the second node N2, for example, the light emitting element 200 is an organic light-emitting diode or a quantum dot light-emitting diode, and the second electrode thereof is an anode. A first terminal of the storage capacitor C0 is coupled to the control terminal of the driving circuit 160, and a second terminal of the storage capacitor C0 is coupled to the second terminal of the driving circuit 160. For example, the storage capacitor C0 can be configured to store a voltage difference (e.g. the voltage difference is related to a data voltage signal) between the control terminal and the second terminal of the driving circuit 160 so as to control the magnitude of the driving current. The driving control circuit 165 is configured to apply a data signal DATA to the control terminal of the driving circuit 160 in response to a scan signal SN, to provide a first voltage VDD to the first node N1 in response to a light emitting control signal EM, and to reset the second node N2 in response to a reset signal RS. For example, the data signal DATA can include a reference voltage signal and a data voltage signal.

Figure 6B:
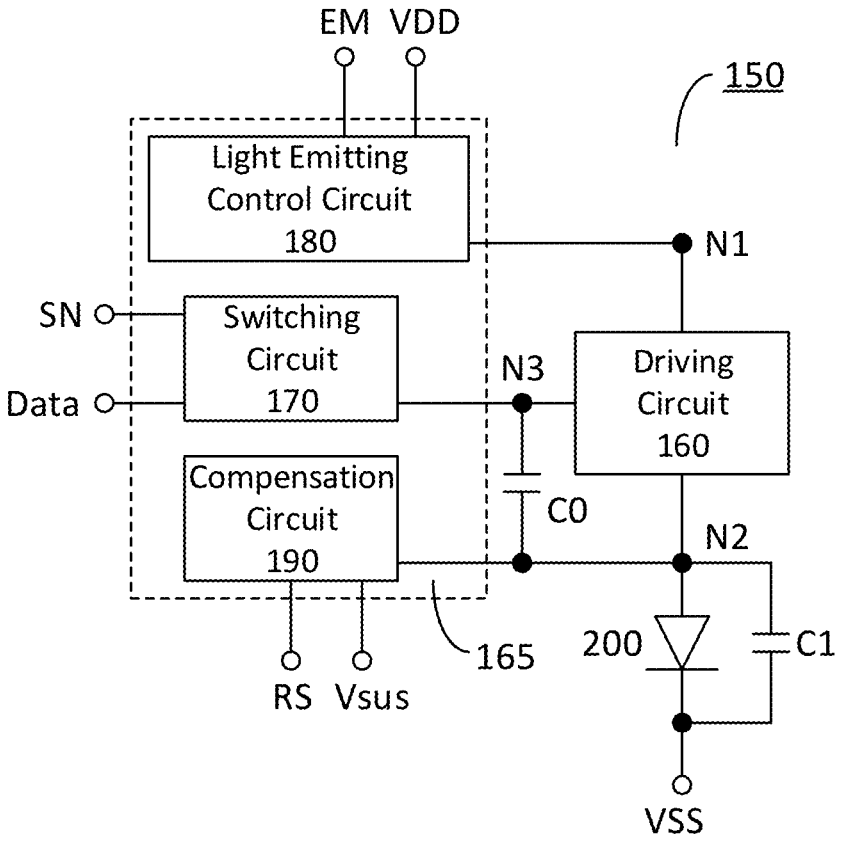
FIG. 6B is a schematic block diagram of an implementation example of the pixel circuit shown in FIG. 6A.

FIG. 6B is a schematic block diagram of an implementation example of the pixel circuit shown in FIG. 6A. For example, as shown in FIG. 6B, in the pixel circuit 150, the driving control circuit 165 can include a switching circuit 170. For example, a first terminal of the switching circuit 170 is connected with a data signal terminal to receive the data signal DATA, a second terminal of the switching circuit 170 is connected with the third node N3 (i.e., connected with the control terminal of the driving circuit 160), and a control terminal of the switching circuit 170 is connected with a scan signal terminal to receive the scan signal SN. For example, the data signal DATA includes the reference voltage signal and the data voltage signal, and the switching circuit 170 is configured to respectively apply the reference voltage signal and the data voltage signal to the control terminal of the driving circuit 160 in response to the scan signal SN.

For example, as shown in FIG. 6B, in some examples, in the pixel circuit 150, the driving control circuit 165 further includes a light emitting control circuit 180. For example, a first terminal of the light emitting control circuit 180 is connected with a first power terminal to receive the first voltage VDD (e.g., the high-level voltage), a second terminal of the light emitting control circuit 180 is connected with the first node N1, and a control terminal of the light emitting control circuit 180 is connected with a light emitting control signal terminal to receive the light emitting control signal EM. The light emitting control circuit 180 is configured to provide the first voltage VDD to the first node N1 in response to the light emitting control signal EM.

For example, as shown in FIG. 6B, in some examples, in the pixel circuit 150, the driving control circuit 165 further includes a reset circuit 190. For example, a first terminal of the reset circuit 190 is connected with a reset voltage terminal to receive a reset voltage Vsus, a second terminal of the reset circuit 190 is connected with the second node N2, and a control terminal of the reset circuit 190 is connected with a reset signal terminal to receive the reset signal RS. The reset circuit 190 is configured to reset the second node N2 in response to the reset signal RS.

It should be noted that it is illustrative that the driving control circuit 165 in FIG. 6A is implemented as the switching circuit 170, the light emitting control circuit 180 and the reset circuit 190 in FIG. 6B. And the driving control circuit 165 can also be implemented in any other possible circuit form, as long as the functions required by the present disclosure can be realized. The present disclosure is not limited thereto.

In addition, other circuit structures of the pixel circuit shown in FIG. 6B are substantially the same as those of the pixel circuit shown in FIG. 6A, and details will not be repeated here.

For example, one example of the pixel circuit 150 shown in FIG. 6B can be embodied as the pixel circuit 100 shown in FIG. 2. As shown in FIG. 2, the pixel circuit 100 includes four transistors T0-T4 and the storage capacitor C0. It should be noted that the transistors adopted in the embodiments of the present disclosure can be thin film transistors or field effect transistors or other switching components having the same characteristics. In the embodiments of the present disclosure, thin film transistors are exemplified for description. The source electrode and the drain electrode of a transistor used here can be symmetrical in structure, so the source electrode and the drain electrode can be structurally indistinguishable. In the embodiments of the present disclosure, in order to distinguish the two electrodes of the transistor in addition to the gate electrode, it is directly described that one electrode is a first electrode and the other electrode is a second electrode.

For example, with reference to FIGS. 6B and 2, the driving circuit 160 can include a driving transistor T0. A first electrode of the driving transistor T0 serves as the first terminal of the driving circuit 160 and is connected with the first node N1; a second electrode of the driving transistor T0 serves as the second terminal of the driving circuit 160 and is connected with the second node N2; and a gate electrode of the driving transistor T0 serves as the control terminal of the driving circuit 160 and is connected with the third node N3.

For example, with reference to FIGS. 6B and 2, the switching circuit 170 can include a first transistor T1. A gate electrode of the first transistor T1 serves as the control terminal of the switching circuit 170, and is connected with the scan signal terminal to receive the scan signal SN; a first electrode of the first transistor T1 serves as the first terminal of the switching circuit 170, and is connected with the data signal terminal to receive the data signal DATA, and for example, the data signal DATA includes the reference voltage signal and the data voltage signal; and a second electrode of the first transistor T1 serves as the second terminal of the switching circuit 170, and is connected with the third node N3.

For example, with reference to FIGS. 6B and 2, the light emitting control circuit 180 can include a second transistor T2. A gate electrode of the second transistor T2 serves as the control terminal of the light emitting control circuit 180, and is connected with the light emitting control signal terminal to receive the light emitting control signal EM; a first electrode of the second transistor T2 serves as the first terminal of the light emitting control circuit 180, and is connected with the first power terminal to receive the first voltage VDD (e.g. the high-level voltage); and a second electrode of the second transistor T2 serves as the second terminal of the light emitting control circuit 180 and is connected with the first node N1.

For example, with reference to FIGS. 6B and 2, the reset circuit 190 can include a third transistor T3. A gate electrode of the third transistor T3 serves as the control terminal of the reset circuit 190, and is connected with the reset signal terminal to receive the reset signal RS; a first electrode of the third transistor T3 serves as the first terminal of the reset circuit 190, and is connected with the reset voltage terminal to receive the reset voltage Vsus; and a second electrode of the third transistor T3 serves as the second terminal of the reset circuit 190, and is connected with the second node N2.

It should be noted that it is illustrative that the pixel circuit 150 shown in FIG. 6B can be implemented as the pixel circuit 100 shown in FIG. 2. And the pixel circuit 150 can also be implemented in any other possible circuit form, as long as the functions required by the present disclosure can be realized. The present disclosure is not limited thereto.

For example, as shown in FIGS. 6A, 6B, and 2, the pixel circuit in each pixel unit 50 can further include a first capacitor C1, a first terminal of the first capacitor C1 is coupled to the first electrode of the light emitting element 200, and a second terminal of the first capacitor C1 is coupled to the second electrode of the light emitting element 200.

It should be noted that in some embodiments of the present disclosure, the capacitor (e.g., the storage capacitor C0 and the first capacitor C1) can be a capacitive component fabricated by a process. For example, the capacitive component is implemented by fabricating specific capacitor electrodes, and each electrode of the capacitor can be implemented by a metal layer, a semiconductor layer (e.g., doped polysilicon), etc. In some embodiments, the capacitor can also be a parasitic capacitance between various components, and can be realized by a transistor itself together with other components and circuits. The connection manners of the capacitors are not limited to the manners described above, and can also be other suitable connection manners, as long as the potential of the corresponding node can be stored.

It should be noted that in the description of various embodiments of the present disclosure, the first node N1, the second node N2 and the third node N3 do not represent actual components, but rather junction points of related electrical connections in the circuit diagram.

In addition, the transistors in the embodiments of the present disclosure are all described by taking N-type transistors as examples. In this case, the first electrode of the transistor is a drain electrode, and the second electrode thereof is a source electrode. It should be noted that the present disclosure includes but is not limited to this case. For example, one or more transistors in the pixel circuit 100 provided by the embodiments of the present disclosure can also adopt P-type transistors. In this case, the first electrode of the transistor is the source electrode, and the second electrode thereof is the drain electrode. All that is needed is to connect respective electrodes of transistors of the selected type with reference to the connection manners of respective electrodes of the corresponding transistors in the embodiments of the present disclosure and to allow the corresponding voltage terminals to provide corresponding high-level voltages or low-level voltages. When an N-type transistor is adopted, Indium Gallium Zinc Oxide (IGZO) can be used as the active layer of the thin film transistor. Compared with using Low Temperature Poly Silicon (LTPS) or amorphous silicon (such as hydrogenated amorphous silicon) as the active layer of the thin film transistor, the size of the transistor can be effectively reduced and leakage current can be prevented.

At least one embodiment of the present disclosure further provides a driving method corresponding to the pixel array substrate 20 provided by the above embodiments. The method includes: providing, during a non-light emitting phase of the plurality of pixel units 50 in each pixel row, a first power signal to the common electrode 205 in the each pixel row, so as to set the light emitting elements 200 of the plurality of pixel units 50 in the each pixel row in a reverse bias state; and providing, during a light emitting phase of the plurality of pixel units 50 in the each pixel row, a second power signal to the common electrode 205 in the each pixel row, so as to set the light emitting elements 200 of the plurality of pixel units 50 in the each pixel row in a forward bias state.

Hereinafter, by taking that the pixel circuit 150 of the pixel unit 50 in the pixel array substrate 20 shown in FIG. 5A is implemented as the pixel circuit shown in FIG. 6B as an example and taking that the pixel circuit shown in FIG. 6B is implemented as the pixel circuit 100 shown in FIG. 2 (taking that each transistor is an N-type transistor as an example) as a reference, the driving method mentioned above is described in detail in combination with the signal timing chart shown in FIG. 7. And the repetition of the above description is briefly illustrated, and the specific details can be with reference to the above description.

Figure 7:
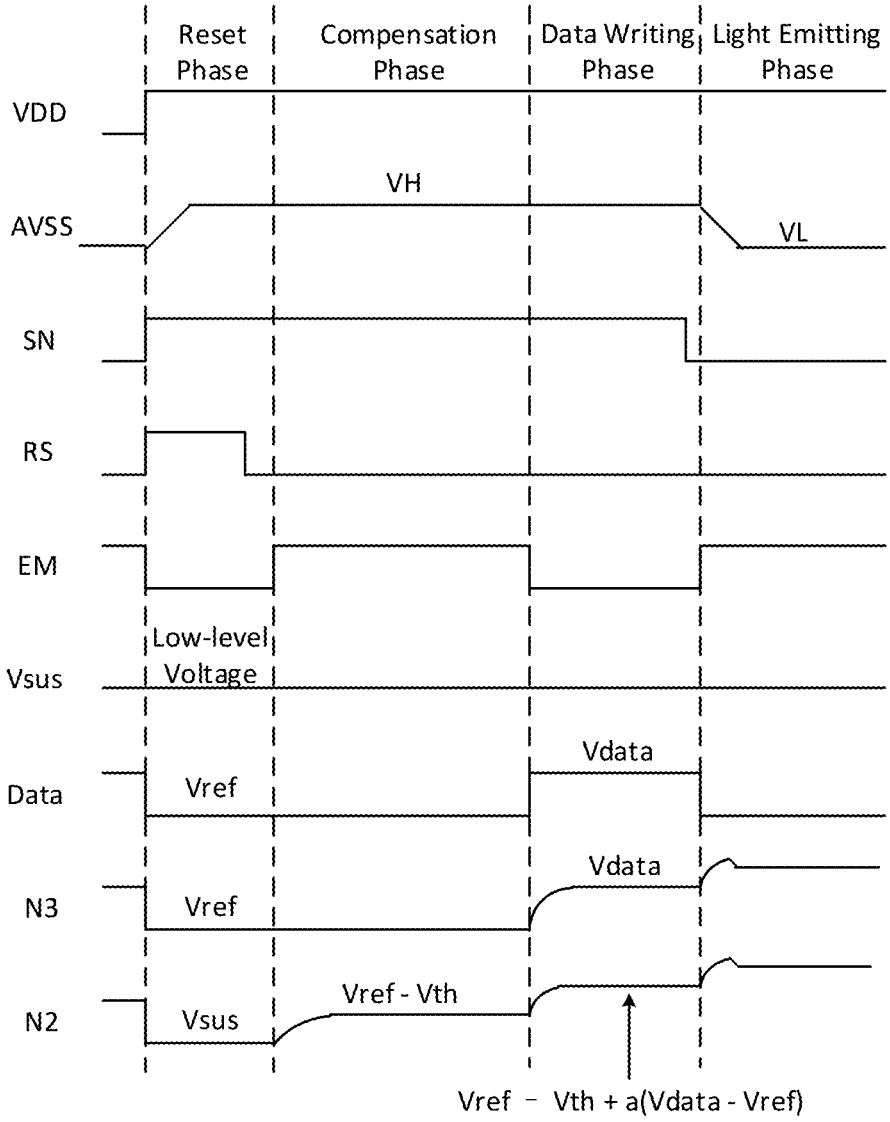
FIG. 7 is a signal timing chart when the pixel array substrate shown in FIG. 5A is in operation.

FIG. 7 is a signal timing chart when the pixel array substrate shown in FIG. 5A is in operation in the above case. The signal timing chart shown in FIG. 7 differs from the signal timing chart shown in FIG. 3 in that: the second voltage VSS is always kept as a low-level voltage in FIG. 3, while the power signal AVSS provided by a power supply device is a variable signal. And specifically, during the non-light emitting phase (e.g., the reset phase, compensation phase, and data writing phase), the power supply device provides a first power signal VH (e.g., at a high level) which enables the light emitting element 200 to be in a reverse bias state, and during the light emitting phase, the power supply device provides a second power signal VL (e.g., at a low level or ground level) which enables the light emitting element 200 to be in a forward bias state. It should be noted that the difference between the signal timing chart shown in FIG. 7 and the signal timing chart shown in FIG. 3 will not affect the normal operation of the pixel circuit 100 shown in FIG. 2. Therefore, specific details of the operation principle of the pixel circuit 100 shown in FIG. 2 according to the signal timing chart shown in FIG. 7 can be with reference to the foregoing description of the operation principle of the pixel circuit 100 shown in FIG. 2 according to the signal timing chart shown in FIG. 3.

It should be noted that, as shown in FIG. 7, in the case where the power signal AVSS is a variable signal, by prolonging the duration of the rising edge or/and falling edge of the power signal AVSS (i.e., increasing the duty cycle of the rising edge or/and falling edge), the change of the power signal AVSS can be transferred from abrupt change to gradual change when switching between VH and VL, so as to reduce the influence on the voltage of the second node N2 during switching.

It should also be noted that the potential level in the signal timing chart shown in FIG. 7 is merely illustrative, and it does not represent a real potential value or a relative proportion. Corresponding to the above examples, a high-level signal corresponds to a turn-on signal of the N-type transistors, while a low-level signal corresponds to a turn-off signal of the N-type transistors.

For example, as shown in FIG. 6B, the pixel circuit 150 of each pixel unit 50 in the pixel array substrate 20 includes a driving circuit 160, a storage capacitor C0, a switching circuit 170, a light emitting control circuit 180, and a reset circuit 190. A first terminal of the driving circuit 160 is connected with a first node N1, a second terminal of the driving circuit 160 is connected with a second node N2, and a control terminal of the driving circuit 160 is connected with a third node N3 and is configured to control a driving current which flows through the first node N1 and the second node N2 and is used for driving the light emitting element 200; a second electrode of the light emitting element 200 is connected with the second node N2 (the first electrode of the light emitting element 200 is connected with the common electrode 205); a first terminal of the storage capacitor C0 is coupled to the control terminal of the driving circuit 160, and a second terminal of the storage capacitor C0 is coupled to the second terminal of the driving circuit 160; the switching circuit 170 is configured to apply a data signal DATA (for example, the data signal DATA includes a reference voltage signal and a data voltage signal) to the control terminal of the driving circuit 160 in response to a scan signal SN; the light emitting control circuit 180 is configured to provide a first voltage VDD to the first node N1 in response to a light emitting control signal EM; and the reset circuit 190 is configured to reset the second node N2 in response to a reset signal RS.

For example, as shown in FIG. 7, the non-light emitting phase includes a reset phase, a compensation phase and a data writing phase. Correspondingly, the driving method further includes: in the reset phase, inputting the reset signal RS, the scan signal SN and the reference voltage signal Vref, so that the reset circuit 190 and the switching circuit 170 are turned on, the reset circuit 190 resets the light emitting element 200, the switching circuit 170 writes the reference voltage signal Vref into the control terminal of the driving circuit 160, and the reference voltage signal Vref is stored in the storage capacitor C0; during the compensation phase, inputting the scan signal SN, the light emitting control signal EM and the reference voltage signal Vref, so that the switching circuit 170, the driving circuit 160 and the light emitting control circuit 180 are turned on, the switching circuit 170 continuously writes the reference voltage signal Vref into the control terminal of the driving circuit 160 to maintain a voltage of the control terminal of the driving circuit 160, and the light emitting control circuit 180 compensates for the driving circuit 160; during the data writing phase, inputting the scan signal SN and the data voltage signal Vdata, so that the switching circuit 170 is turned on, the switching circuit 170 writes the data voltage signal Vdata into the control terminal of the driving circuit 160, and the data voltage signal Vdata is stored in the storage capacitor C0; and during the light emitting phase, inputting the light emitting control signal EM, so that the light emitting control circuit 180 and the driving circuit 160 are turned on, and the driving circuit 160 applies the driving current to the light emitting element 200 so as to drive the light emitting element 200 to emit light.

The pixel array substrate provided by the embodiments of the present disclosure can be driven by adopting the driving method described above, so that the brightness of the light emitting elements can be accurately controlled and the display quality can be improved.

At least one embodiment of the present disclosure further provides a display panel, which includes the pixel array substrate provided by any one of the above embodiments. The display panel can further include a gate driving circuit, a data driving circuit, etc. The description of the gate driving circuit, the data driving circuit, etc., can be with reference to the specific description of the organic light-emitting diode display panel 1 shown in FIG. 1, and details will not be repeated herein.

For example, in some examples, the display panel can include an integrated circuit driving chip, and the aforementioned first power signal and second power signal are provided by the integrated circuit driving chip. For example, the integrated circuit driving chip can be bonded to the pixel array substrate in the form of chip on film (C0F). For example, in some other examples, a driving circuit similar to the gate driving circuit can be provided on the pixel array substrate of the display panel, and the aforementioned first power signal and second power signal are provided by the driving circuit. For example, in further other examples, the gate driving circuit itself on the pixel array substrate can provide the aforementioned first power signal and second power signal. The present disclosure is not limited to these cases.

The technical effects of the display panel provided by the embodiments of the present disclosure can be with reference to the related description of the pixel array substrate 20 in the above embodiments, and details will not be described here again.

At least one embodiment of the present disclosure further provides a display device, which includes the display panel provided by any one of the above embodiments.

The display device in the present embodiment can be any product or component having a display function, such as a display, a television, an electronic paper display device, a mobile phone, a tablet computer, a notebook computer, a digital photo frame, a navigator, etc. It should be noted that the display device can also include other conventional components or structures. For example, in order to realize necessary functions of the display device, those skilled in the art can set other conventional components or structures according to specific application scenarios, without being limited in the embodiments of the present disclosure.

The technical effects of the display device provided by the embodiments of the present disclosure can be with reference to the related description of the pixel array substrate 20 in the above embodiments, and details will not be described here again.

For the present disclosure, the following statements should be noted:

(1) The accompanying drawings involve only the structure(s) in connection with the embodiment(s) of the present disclosure, and other structure(s) can be referred to common design(s).

(2) For the purpose of clarity only, in accompanying drawings for illustrating the embodiment(s) of the present disclosure, the thickness and size of a layer or a structure may be enlarged or narrowed, that is, the drawings are not drawn in a real scale.

(3) In case of no conflict, the embodiments of the present disclosure and the features in the embodiments can be combined with each other to obtain new embodiments.

What have been described above are only specific implementations of the present disclosure, the protection scope of the present disclosure is not limited thereto. Any changes or modifications easily occur to those skilled in the art within the technical scope of the present disclosure should be covered by the protection scope of the present disclosure. Therefore, the protection scope of the present disclosure should be based on the protection scope of the claims.

What is claimed is:

1. A pixel array substrate, comprising: a plurality of pixel units arranged in a plurality of pixel rows, and common electrodes distributed in the plurality of pixel rows, wherein each of the plurality of pixel units comprises a light emitting element, first electrodes of light emitting elements of a plurality of pixel units in each of the plurality of pixel rows are electrically connected with each other to form a common electrode in the each of the plurality of pixel rows, and the common electrodes in the plurality of pixel rows are insulated from each other;

the common electrode in the each of the plurality of pixel rows is configured to receive a first power signal to set the light emitting elements of the plurality of pixel units in the each of the plurality of pixel rows in a reverse bias state during a non-light emitting phase of the plurality of pixel units in the each of the plurality of pixel rows, and to receive a second power signal to set the light emitting elements of the plurality of pixel units in the each of the plurality of pixel rows in a forward bias state during a light emitting phase of the plurality of pixel units in the each of the plurality of pixel rows;

each of the plurality of pixel units further comprises a driving circuit, a first terminal of the driving circuit is connected with a first node and is configured to receive a first voltage from a first power terminal during the non-light emitting phase and the light emitting phase, a second terminal of the driving circuit is connected with a second node, and a control terminal of the driving circuit is connected with a third node and is configured to control a driving current flowing through the first node and the second node for driving the light emitting element;

a second electrode of the light emitting element is connected with the second node;

a level of the second electrode of the light emitting element during the light emitting phase is greater than a level of the second electrode of the light emitting element during the non-light emitting phase;

the pixel array substrate further comprises a plurality of power signal lines in one-to-one correspondence with the plurality of pixel rows, wherein the common electrode in the each of the plurality of pixel rows is connected with a power signal line corresponding to the each of the plurality of pixel rows, and the first power signal and the second power signal are transmitted to the common electrode in the each of the plurality of pixel rows via the power signal line corresponding to the each of the plurality of pixel rows;

the pixel array substrate further comprises a pixel defining layer for defining the plurality of pixel units, wherein the pixel defining layer comprises a plurality of via holes, and the common electrode in the each of the plurality of pixel rows is connected with the power signal line corresponding to the each of the plurality of pixel rows through at least one of the plurality of via holes; and the pixel array substrate further comprises a plurality of auxiliary cathodes in one-to-one correspondence with the plurality of via holes, wherein the common electrode in the each of the plurality of pixel rows is connected with at least one of the plurality of auxiliary cathodes through at least one of the plurality of via holes, and the power signal line corresponding to the each of the plurality of pixel rows is connected with the at least one of the plurality of auxiliary cathodes.

2. The pixel array substrate according to claim 1, wherein each of the plurality of pixel units further comprises a storage capacitor and a driving control circuit;

a first terminal of the storage capacitor is coupled to the control terminal of the driving circuit, and a second terminal of the storage capacitor is coupled to the second terminal of the driving circuit; and the driving control circuit is configured to respectively apply a reference voltage signal and a data voltage signal to the control terminal of the driving circuit in response to a scan signal, and to provide the first voltage to the first node in response to a light emitting control signal, and to reset the second node in response to a reset signal.

3. The pixel array substrate according to claim 2, wherein the driving circuit comprises a driving transistor, a first electrode of the driving transistor serves as the first terminal of the driving circuit, a second electrode of the driving transistor serves as the second terminal of the driving circuit, and a gate electrode of the driving transistor serves as the control terminal of the driving circuit.

4. The pixel array substrate according to claim 2, wherein the driving control circuit comprises:

a switching circuit, configured to respectively apply the reference voltage signal and the data voltage signal to the control terminal of the driving circuit in response to the scan signal.

5. The pixel array substrate according to claim 4, wherein the switching circuit comprises a first transistor, a gate electrode of the first transistor is connected with a scan signal terminal to receive the scan signal, a first electrode of the first transistor is connected with a data signal terminal to receive the reference voltage signal and the data voltage signal, and a second electrode of the first transistor is connected with the third node.

6. The pixel array substrate according to claim 4, wherein the driving control circuit further comprises:

a light emitting control circuit, configured to provide the first voltage to the first node in response to the light emitting control signal.

7. The pixel array substrate according to claim 6, wherein the light emitting control circuit comprises a second transistor, a gate electrode of the second transistor is connected with a light emitting control signal terminal to receive the light emitting control signal, a first electrode of the second transistor is connected with the first power terminal to receive the first voltage, and a second electrode of the second transistor is connected with the first node.

8. The pixel array substrate according to claim 6, wherein the driving control circuit further comprises:

a reset circuit, configured to reset the second node in response to the reset signal.

9. The pixel array substrate according to claim 8, wherein the reset circuit comprises a third transistor, a gate electrode of the third transistor is connected with a reset signal terminal to receive the reset signal, a first electrode of the third transistor is connected with a reset voltage terminal to receive a reset voltage, and a second electrode of the third transistor is connected with the second node.

10. The pixel array substrate according to claim 2, wherein each of the plurality of pixel units further comprises a first capacitor, a first terminal of the first capacitor is coupled to the first electrode of the light emitting element, and a second terminal of the first capacitor is coupled to the second electrode of the light emitting element.

11. A display panel, comprising: the pixel array substrate according to claim 1.

12. A display device, comprising: the display panel according to claim 11.

13. A driving method of the pixel array substrate according to claim 1, comprising:

providing, during the non-light emitting phase of the plurality of pixel units in the each of the plurality of pixel rows, the first power signal to the common electrode in the each of the plurality of pixel rows, so as to set the light emitting elements of the plurality of pixel units in the each of the plurality of pixel rows in the reverse bias state; and providing, during the light emitting phase of the plurality of pixel units in the each of the plurality of pixel rows, the second power signal to the common electrode in the each of the plurality of pixel rows, so as to set the light emitting elements of the plurality of pixel units in the each of the plurality of pixel rows in the forward bias state.

14. The driving method according to claim 13, wherein each of the plurality of pixel units further comprises a storage capacitor, a switching circuit, a light emitting control circuit and a reset circuit;

a first terminal of the storage capacitor is coupled to the control terminal of the driving circuit, and a second terminal of the storage capacitor is coupled to the second terminal of the driving circuit; the switching circuit is configured to respectively apply a reference voltage signal and a data voltage signal to the control terminal of the driving circuit in response to a scan signal; the light emitting control circuit is configured to provide the first voltage to the first node in response to a light emitting control signal; the reset circuit is configured to reset the second node in response to a reset signal;

the non-light emitting phase comprises a reset phase, a compensation phase and a data writing phase; and the driving method further comprises:

during the reset phase, inputting the reset signal, the scan signal and the reference voltage signal, so that the reset circuit and the switching circuit are turned on, the reset circuit resets the light emitting element, the switching circuit writes the reference voltage signal into the control terminal of the driving circuit, and the reference voltage signal is stored in the storage capacitor;

during the compensation phase, inputting the scan signal, the light emitting control signal and the reference voltage signal, so that the switching circuit, the driving circuit and the light emitting control circuit are turned on, the switching circuit continuously writes the reference voltage signal into the control terminal of the driving circuit to maintain a voltage of the control terminal of the driving circuit, and the light emitting control circuit compensates for the driving circuit;

during the data writing phase, inputting the scan signal and the data voltage signal, so that the switching circuit is turned on, the switching circuit writes the data voltage signal into the control terminal of the driving circuit, and the data voltage signal is stored in the storage capacitor; and during the light emitting phase, inputting the light emitting control signal, so that the light emitting control circuit and the driving circuit are turned on, and the driving circuit applies the driving current to the light emitting element so as to drive the light emitting element to emit light.

* * * * *